United States Patent [19]

Suzuki et al.

[11] 4,002,479

[45] Jan. 11, 1977

[54] 2-THIOURACIL IN HEAT-DEVELOPABLE LIGHT-SENSITIVE MATERIALS

[75] Inventors: Nobuo Suzuki; Yasuhiro Noguchi; Takao Masuda, all of Asaka, Japan

[73] Assignee: Fuji Photo Film Co., Ltd., Minami-ashigara, Japan

[22] Filed: June 25, 1975

[21] Appl. No.: 590,524

[30] Foreign Application Priority Data

June 26, 1974 Japan ..... 49-72992

[52] U.S. Cl. ..... 96/114.1; 96/109

[51] Int. Cl.[2] ..... G03C 1/02; G03C 1/34

[58] Field of Search ..... 96/114.1, 109

[56] References Cited

UNITED STATES PATENTS

| | | | |
|---|---|---|---|
| 2,231,127 | 2/1941 | Kendall | 96/109 |
| 3,617,289 | 11/1971 | Ohkubo et al. | 96/114.1 |
| 3,893,859 | 7/1975 | Burness et al. | 96/114.1 |

FOREIGN PATENTS OR APPLICATIONS

| | | | |
|---|---|---|---|
| 1,264,954 | 7/1968 | United Kingdom | 96/114.1 |

*Primary Examiner*—David Klein
*Assistant Examiner*—Louis Falasco
*Attorney, Agent, or Firm*—Sughrue, Rothwell, Mion, Zinn & Macpeak

[57] ABSTRACT

A heat-developable light-sensitive material which comprises a support containing therein or in one or more layers thereon at least (a) an organic silver salt; (b) a light-sensitive silver halide or a component capable of forming a light-sensitive silver halide on reaction with the organic silver salt; (c) a reducing agent, and (d) a 2-thiouracil.

10 Claims, No Drawings

2-THIOURACIL IN HEAT-DEVELOPABLE LIGHT-SENSITIVE MATERIALS

BACKGROUND OF THE INVENTION

1. Field of the Invention

The present invention relates to heat-developable light-sensitive materials. More particularly, it relates to heat-developable light-sensitive materials having high sensitivity and less heat fog, i.e., undesirable blackening at the non-image areas caused by heat-developing.

2. Description of the Prior Art:

The photographic process using silver halides has been most widely practiced hitherto, because excellent photographic properties such as good sensitivity and gradation can be obtained in this process as compared with other photographic processes such as an electrophotographic process or a diazo photographic process. However, silver halide light-sensitive materials used in this process are subjected to development using a developer after image exposure and then subjected to processings such as stopping, fixation, water washing or stabilization to prevent the developed images from fading or discoloring under normal room illumination and to prevent the undeveloped areas (hereinafter called "background") from blackening. Accordingly, these processings take much time and are laborsome. Further, there are problems in that the handling of the chemicals used is dangerous to the human body or the hands and clothes of the workers and the processing room are stained at processing. In addition, the processing solutions discharged into rivers and streams cause environmental pollution. Thus, it is very desired to improve the photographic process using silver halides so that the processings can be carried out in a dry manner without using solution processings and the processed images can be stabilized and so that the background is not colored under normal room illumination.

Therefore, many approaches to achieve such have been attempted hitherto. For instance, a silver halide emulsion containing a 3-pyrazolidone developing agent which can be developed by heating is described in German Patent 1,123,203 and 1,174,157. Further, in this case, the reaction is accelerated when a substance which generates water on heating is present as described in German Patent 1,175,075. Further, German Patent 1,003,578 discloses a silver halide with a fixing agent therefor. However, it is impossible using these techniques to completely stabilize the silver halide remaining in the photosensitive material against light after processing in a dry state. That is, no description relative to a fixation of the material using dry processing is present in the three patents described immediately above, and also in the last patent described immediately above it can easily be understood that putting the material to practical use would be difficult, since an undesired reaction will occur during storage due to the co-presence of the developing agent (reducing agent) and the fixing agent. These defects have now been confirmed experimentally.

Today, the most successful photosensitive material capable of forming a photographic image suitable for processing in a dry state is a heat-developable photosensitive material which utilizes a composition containing a silver salt of an organic acid, a small amount of a silver halide and a reducing agent as the requisite components as described in U.S. Pat. Nos. 3,152,904 and 3,457,075. In these heat-developable light-sensitive materials, after development the silver halide remaining in the light-sensitive material is not stabilized to light but rather allowed to be colored by light. Even so, the same effect as that obtained by stabilization can be attained, since the amount of the silver halide used is small and the major part of the composition comprises stable white or lightly colored organic silver salts which are not blackened by light. Even if a small amount of the silver halide is colored by light, the overall appearance of the material is white or slightly colored, and the slight coloring is not a problem when viewed visually. These light-sensitive materials are stable at room temperature (e.g., about 20–30° C), but when the material is heated to a temperature of about 80° C, preferably 100° C, after exposure, the organic silver salt oxidizing agent and the reducing agent in the light-sensitive layer undergo an oxidation-reduction reaction due to the catalytic action of the exposed silver halide present in the vicinity and silver is produced. Thus, the exposed areas of the light-sensitive layer are rapidly blackened and a difference in contrast with respect to the non-exposed areas (background) occurs to form images.

However, in these heat-developable light-sensitive materials, there is a tendency toward the production of undesirable blackening (hereinafter designated "heat fog") in the background, and this has become an important problem to be solved. That is, the heat fog relatively reduces the optical density of the image portion formed at the exposed area, and makes the image difficult to distinguish. As a technique of inhibiting heat fog, it is known to add mercury (II) ions to the light-sensitive layer as described in Japanese Patent Publication No. 11113/72. However, mercury compounds are toxic, and a problem of secondary pollution occurs in the regeneration of the waste light-sensitive paper and also a problem of volatilization of the mercury compounds when the material is heat-developed occurs.

Further, many approaches toward decreasing heat fog have been attempted hitherto. However, it is well known to one skilled in the art that it is very difficult to inhibit heat fog without degrading the photographic properties. Sensitivity is, in general, reduced by adding a heat fog inhibiting agent.

SUMMARY OF THE INVENTION

Therefore, an object of the present invention is to provide heat-developable light-sensitive materials which have a low heat fogging property.

Another object of the present invention is to provide heat-developable light-sensitive materials having high sensitivity.

These and other objects of the present invention will be clear from the following description of the invention.

As the result of much research in order to achieve the above objects, it has now been unexpectedly found that a heat-developable light-sensitive material which comprises a support containing therein or having in one or more layers thereon at least (a) an organic silver salt; (b) a light-sensitive silver halide or a component capable of forming a light-sensitive silver halide on reaction with the organic silver salt; and (c) a reducing agent with also (d) a 2-thiouracil exhibits a marked decrease in heat fog and an increase in sensitivity.

DETAILED DESCRIPTION OF THE INVENTION

The 2-thiouracils, component (d), which are an important characteristic in the present invention are compounds represented by the following general formula (I):

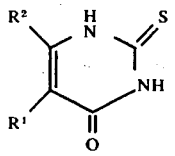

(I)

wherein $R^1$ is a hydrogen atom; a hydroxyl group; an alkoxyl group containing 1 to 5 carbon atoms (such as a methoxy group, an ethoxy group, a propoxy group, a butoxy group or a pentyloxy group); a phenoxy group; a halogen atom (such as a fluorine atom, a chlorine atom, a bromine atom or an iodine atom); an alkyl group (such as an unsubstituted alkyl group containing 1 to 6 carbon atoms (e.g., a methyl group, an ethyl group or an n-hexyl group) or a substituted alkyl group having 1 to 6 carbon atoms in the alkyl moiety thereof as described above and substituted with one or more of a halogen atom (such as those described above), a hydroxyl group, or an alkoxyl group containing 1 to 4 carbon atoms (such as a methoxy group, an ethoxy group, a propoxy group or a butoxy group); a benzyl group; an allyl group; an amino group such as an amino group, an N-alkylamino group (e.g., an N-methylamino group), an N,N-dialkylamino group (e.g., an N,N-dimethylamino group, an N,N-diethylamino group, etc.); a nitro group or a nitroso group. $R^2$ is a hydrogen atom; a halogen atom (such as those described above); a hydroxyl group; an amino group such as an amino group, an N-alkylamino group (e.g., an N-methylamino group), an N,N-dialkylamino group (e.g., an N,N-dimethylamino group, an N,N-diethylamino group, etc.); an acetamido group; an unsubstituted alkyl group containing 1 to 22 carbon atoms (such as a methyl group, an ethyl group, an n-propyl group, an iso-propyl group, an n-butyl group, an n-octyl group, a dodecyl group, a tetradecyl group, a hexadecyl group, or an eicosyl group); an aryl group such as an unsubstituted aryl group (e.g., a phenyl group, an $\alpha$-naphthyl group, or $\beta$-naphthyl group), or a substituted aryl group containing an aryl moiety as described above and substituted with one or more of an alkyl group containing 1 to 4 carbon atoms (such as a methyl group, an ethyl group, a butyl group, a halogen atom (such as those described above), a hydroxyl group, an amino group such as an amino group, an N-alkylamino group (e.g., an N-methylamino group), an N,N-dialkylamino group (e.g., an N,N-dimethylamino group, an N,N-diethylamino group, etc.), an acetamido group, or a nitro group.

Typical examples of the above-described 2-thiouracils are as follows:

(1) 2-thiouracil
(2) 5-methyl-2-thiouracil
(3) 5,6-dimethyl-2-thiouracil
(4) 6-ethyl-5-methyl-2-thiouracil
(5) 6-methyl-5-n-propyl-2-thiouracil
(6) 5-ethyl-2-thioracil
(7) 5-n-propyl-2-thiouracil
(8) 5-n-butyl-2-thiouracil
(9) 5-n-hexyl-2-thiouracil
(10) 5-n-butyl-6-ethyl-2-thiouracil
(11) 5-hydroxy-2-thiouracil
(12) 5,6-dihydroxy-2-thiouracil
(13) 5-hydroxy-6-n-propyl-2-thiouracil
(14) 5-methoxy-2-thiouracil
(15) 5-n-butoxy-2-thiouracil
(16) 5-methoxy-6-n-propyl-2-thiouracil
(17) 5-bromo-2-thiouracil
(18) 5-chloro-2-thiouracil
(19) 5-fluoro-2-thiouracil
(20) 5-amino-2-thiouracil
(21) 5-amino-6-methyl-2-thiouracil
(22) 5-amino-6-phenyl-2-thiouracil
(23) 5,6-diamino-2-thiouracil
(24) 5-allyl-2-thiouracil
(25) 5-allyl-3-ethyl-2-thiouracil
(26) 5-allyl-6-phenyl-2-thiouracil
(27) 5-benzyl-2-thiouracil
(28) 5-benzyl-6-methyl-2-thiouracil
(29) 5-acetamido-2-thiouracil
(30) 6-methyl-5-nitro-2-thiouracil
(31) 6-amino-2-thiouracil
(32) 6-amino-5-methyl-2-thiouracil
(33) 6-amino-5-n-propyl-2-thiouracil
(34) 6-bromo-2-thiouracil
(35) 6-chloro-2-thiouracil
(36) 6-fluoro-2-thiouracil
(37) 6-bromo-5-methyl-2-thiouracil
(38) 6-hydroxy-2-thiouracil
(39) 6-acetamido-2-thiouracil
(40) 6-n-octyl-2-thiouracil
(41) 6-dodecyl-2-thiouracil
(42) 6-tetradodecyl-2-thiouracil
(43) 6-hexadecyl-2-thiouracil
(44) 6-(2-hydroxyethyl)-2-thiouracil
(45) 6-(3-isopropyloctyl)-5-methyl-2-thiouracil
(46) 6-(m-nitrophenyl)-2-thiouracil
(47) 6-(m-nitrophenyl)-5-n-propyl-2-thiouracil
(48) 6-$\alpha$-naphthyl-2-thiouracil
(49) 6-$\alpha$-naphthyl-5-t-butyl-2-thiouracil
(50) 6-(p-chlorophenyl)-2-thiouracil
(51) 6-(p-chlorophenyl)-2-ethyl-2-thiouracil
(52) 5-ethyl-6-eicosyl-2-thiouracil
(53) 6-acetamido-5-ethyl-2-thiouracil
(54) 6-eicosyl-5-allyl-2-thiouracil
(55) 5-amino-6-phenyl-2-thiouracil
(56) 5-amino-6-(p-chlorophenyl)-2-thiouracil
(57) 5-methoxy-6-phenyl-2-thiouracil
(58) 5-ethyl-6-(3,3-dimethyloctyl)-2-thiouracil
(59) 6-(2-bromoethyl)-2-thiouracil.

The mechanism by which the effect obtained using the above-described component (d) of the present invention is not clear, but the following is extraordinarily surprising. That is, heat-developable light-sensitive materials containing component (d) of the present invention have decreased heat fog and increased photographic sensitivity as compared with known heat-developable light-sensitive materials which do not contain component (d).

The 2-thiouracils described above can be added at any time before or after forming the organic silver salt component, (a) as described below, before or after forming the silver halide component (b) or before or after adding a reducing agent component (c), a toning agent, etc. Further, part of the 2-thiouracils described above can be added at different times so that the total amount to be employed is added at various points during production. However, the 2-thiouracil is preferably added when the silver halide is formed after forming component (a) where the heat-developable light-sensitive material produced thereby has a light-sensitivity which is a few times higher than the light-sensitivity of a heat-developable photographic material produced wherein the 2-thiouracil is added at other times during production or the 2-thio-uracil is not present. In this invention, the 2-thiouracils described before can be employed individually or as a combination thereof. A suitable amount of 2-thiouracils employed in the invention ranges from about $1 \times 10^{-4}$ mole to about $5 \times 10^{-2}$ mole, preferably from about $2 \times 10^{-4}$ mole to about $4 \times 10^{-3}$ mole, per mole of an organic silver salt component (a).

The organic silver salts of component (a) used in the present invention are colorless, white or lightly colored silver salts which are comparatively stable to light and form silver images by reacting with the reducing agent when heated to a temperature above about 80° C, and preferably above 100° C, in the presence of the exposed light-sensitive silver halide component (b). Examples of suitable organic silver salts for component (a) are silver salts of organic compounds containing an imino group, a mercapto or thione group, or a carboxyl group.

Suitable specific examples of these compounds are given in the following.

1. Silver salts of organic compounds containing an imino group:

Silver benzotriazole, silver nitrobenzotriazole, silver alkyl-substituted benzotriazoles (e.g., silver methylbenzotriazole, etc.), silver halogen-substituted benzotriazoles (e.g., silver bromobenzotriazole, silver chlorobenzotriazole, etc.), silver carboimido-substituted benzotriazoles (e.g.,

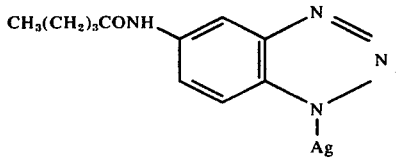

or

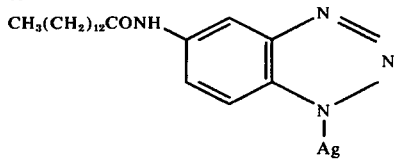

etc.), silver benzoimidazole, silver substituted-benzoimidazoles (e.g., silver 5-chloro benzoimidazole, silver 5-nitrobenzoimidazole, etc.), silver carbazole, silver saccharin, silver phthalazinone, silver substituted-phthalazinones, silver phthalimide, silver pyrrolidone, silver tetrazole, silver imidazole, and the like, 2. Silver salts of compounds having a mercapto group or a thione group:

Silver 3-mercapto-4-phenyl-1,2,4-triazole, silver 2-mercapto-benzimidazole, silver 2-mercapto-5-aminothiadiazole, silver 1-phenyl-5-mercaptotetrazole, silver 2-mercaptobenzothiazole, silver 2-(S-ethylthioglycolamido)benzothiazole, silver thioglycolates as described in Japanese Patent Application (OPI) No. 2822/73 (e.g., silver S-alkyl ($C_{12}$–$C_{22}$)-thioglycolates, etc.), silver dithiocarboxylates (e.g., silver dithioacetate, etc.), silver thioamides, silver thiopyridines (e.g., silver 5-carbethoxy-1-methyl-2-phenyl-4-thiopyridine, etc.), silver dithiodihydroxybenzole, silver mercaptotriazine, silver 2-mercaptobenzooxazole, silver mercaptoxadiazole, and the like.

3. Silver salts of organic compounds having a carboxyl group:

i. Silver salts of aliphatic carboxylic acids:

Silver caprate, silver laurate, silver myristate, silver palmitate, silver stearate, silver behenate, silver maleate, silver fumarate, silver tartrate, silver furoate, silver linoleate, silver oleate, silver hydroxystearate, silver adipate, silver sebacate, silver succinate, silver acetate, silver butyrate, silver camphorate, and the like, ii. Silver salts of aromatic carboxylic acids and others:

Silver benzoate, substituted silver benzoates (e.g., silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.), silver gallate, silver tannate, silver phthalate, silver terephthalate, silver salicylate, silver phenylacetate, silver pyromellitate, silver salt of 4′-n-octadecyloxydiphenyl-4-carboxylic acid, silver salts of a thioncarboxylic acid as described in U.S. Pat. No. 3,785,830, silver salts of an aliphatic carboxylic acid having a thioether group as described in U.S. Pat. No. 3,330,663, and the like.

4. Other silver salts:

Silver 4-hydroxy-6-methyl-1,3,3a,7-tetrazaindene, silver 5-methyl-7-hydroxy-1,2,3,4,6-pentazaindene, silver tetrazaindene as described in British Pat. No. 1,230,642, silver S-2-aminophenylthiosulfate as described in U.S. Pat. No. 3,549,379, silver salts of a metal-containing aminoalcohol as described in Japanese Patent Application (OPI) No. 6586/71, silver salts of an organic acid metal chelate as described in Belgian Pat. No. 768,411, and the like.

If desired, titanium oxide, zinc oxide, metal carboxylates other than silver carboxylates (e.g., gold laurate, gold stearate, gold behenate, etc.) or a like oxidizing agent can be used in combination with the above described organic silver salts.

Several methods for the preparation of these organic silver salts are known. A very simple method for preparing organic silver salts comprises mixing a solution of an organic silver salt forming compound or a salt thereof dissolved in water or water-miscible solvent such as an alcohol or acetone with an aqueous solution of a water-soluble silver salt such as silver nitrate, as described in U.S. Pat. No. 3,457,075.

Also, as described in British Pat. No. 1,347,350, a colloidal solution of an ammonium salt or an alkali metal salt of an organic silver salt forming compound can be mixed with an aqueous solution of a water-soluble silver salt such as silver nitrate. A similar method in which an aqueous solution of a silver complex salt such as a silver amine complex salt or a solution of a silver complex salt dissolved in a water-miscible solvent is used instead of the aqueous solution of the water-soluble silver salt such as silver nitrate can be used.

Another method for preparing organic silver salts is described in U.S. Pat No. 3,458,544. That is, silver salts of organic carboxylic acids are prepared by mixing an aqueous solution of a silver complex salt with a water-immiscible solution (an oily solution, e.g., a benzene solution) of an organic carboxylic acid in a solvent which dissolves the organic carboxylic acid but is immiscible with water. Preferably, the oily solution is emulsified by adding water therein before the aqueous solution of the silver complex salt is mixed therewith. This method can be employed in preparing other organic silver salts as well.

A method for preparing organic silver salts as described in Japanese Pat. No. 30270/69 is similar to this method but the organic silver salts produced are more stable to heat and light. That is, the method uses a silver solution not containing an alkali such as a soluton of silver nitrate only instead of the silver complex salts. According to this method, silver benzotriazole is produced with high efficiency.

Another method for preparing organic silver salts is described in Japanese Patent Application No. 9362/73. This method is desirable because the organic silver salts produced by the method can be used to produce heat-developable light-sensitive materials having less heat fog. That is, this is a method for preparing organic silver salts which comprises mixing an emulsion of an aqueous solution of a salt of a water-soluble organic silver salt forming compound (for example, an alkali metal salt such as a sodium salt, a potassium salt, a lithium salt, etc., an ammonium salt, etc.) and an oil (for example, benzene, toluene, cyclohexane, pentane, hexane, a carboxylic acid ester such as an acetic acid ester, a phosphoric acid ester, an oil such as castor oil, etc.) with a silver salt (e.g., silver nitrate) or a silver complex salt which is more soluble than the organic silver salt, preferably an aqueous solution thereof. A modification of this method is a method which comprises mixing an alkaline aqueous solution (such as an aqueous solution of sodium hydroxide) with an oil-soluble solution of an organic silver salt forming compound (such as a toluene solution of an organic silver salt forming compound) and emulsifying the mixture and then mixing the emulsion with an easily soluble silver salt such as silver nitrate or a silver complex salt such as a silver ammine complex salt, preferably an aqueous solution thereof, to produce an organic silver salt.

Examples of the above-described oil which can be used for forming the oil solution are as follows:

1. Phosphoric acid esters such as tricresyl phosphate, tributyl phosphate, monooctyldibutyl phosphate, etc.,
2. Phthalic acid esters such as diethyl phthalate, dibutyl phthalate, dimethyl phthalate, dioctyl phthalate, dimethoxyethyl phthalate, etc.,
3. Carboxylic acid esters, e.g., acetic acid esters such as amyl acetate, isopropyl acetate, isoamyl acetate, ethyl acetate, 2-ethylbutyl acetate, butyl acetate, propyl acetate; etc., sebacic acid esters such as dioctyl sebacate, dibutyl sebacate, diethyl sebacate, etc., succinic acid esters such as diethyl succinate, etc., formic acid esters such as ethyl formate, propyl formate, butyl formate, amyl formate, etc., valeric acid esters such as ethyl valerate, tartaric acid esters such as diethyl tartarate, etc., butyric acid esters such as methyl butyrate, ethyl butyrate, butyl butyrate, isoamyl butyrate, adipic acid esters, etc.,
4. Oils such as castor oil, soybean oil, linseed oil, tsubaki oil, etc.,
5. Aromatic hydrocarbons such as benzene, toluene, xylene. etc.,
6. Aliphatic hydrocarbons such as pentane, hexane, heptane, etc.,
7. Cyclic hydrocarbons such as cyclohexane, etc.

As the silver complex salt silver ammine complex salt, silver methylamine complex salt, silver ethylamine complex salt, etc., preferably, an alkali soluble silver complex salt having a dissolution constant higher than that of the organic silver salts can be used.

In addition to water, polar solvents such as dimethyl sulfoxide, dimethylformamide, acetonitrile, etc., can be used an solvents for silver salts such as silver nitrate, etc.

Further, ultrasonic waves can be applied during preparation of the organic silver salt as described in Japanese Patent Application No. 7619/73. Particularly, emulsification is facilitated by application of ultrasonic waves when water is emulsified into an oil or vice versa.

Of course, a surface active agent can be used to control the particle size of the organic silver salt obtained during its preparation.

Further, the organic silver salt can be prepared in the presence of a polymer. As a specific method, a method for producing a heavy metal salt such as a silver salt of an organic carboxylic acid by mixing a non-aqueous solution of an organic carboxylic acid and a non-aqueous solution of a heavy metal salt of trifluoroacetate or tetrafluoroborate in the presence of a polymer is described, for example, in U.S. Pat. No. 3,700,458.

A method in which a solution of silver nitrate is applied to a colloid dispersion of the organic silver salt forming agent is also described in French Pat. No. 2,147,286.

Further, a similar method for producing an emulsion using a non-aqueous solution is described in U.S. Pat. No. 3,748,143.

The particle form, particle size, photographic characteristics such as heat fog, light stability, sensitivity, etc., of the organic silver salt can be controlled by adding a metal salt or a metal complex of mercury or lead during the preparation of the organic silver salt as described in Japanese Patent Application Nos. 49436/72, 48453/72 and 43867/72. Metals such as cobalt, manganese, nickel and iron other than mercury and lead are also recognized to be effective. A mixture of a solution or a dispersion of a silver salt forming organic compound and these metal containing compounds can be mixed with an aqueous solution of an easily soluble silver salt such as silver nitrate or an aqueous solution of a silver complex salt such as a silver ammine complex salt. Also, the solution or dispersion of the metal containing compound, the aqueous solution of the silver salt or silver complex salt, and the solution or dispersion of the silver salt forming organic compound can be mixed. Further, the solution or dispersion of the silver salt forming organic compound can suitably be mixed with a mixture of the solution or dispersion of the silver salt or silver complex salt and the solution or dispersion of the metal containing compound.

The amount of the metal containing compound suitably ranges from about $10^{-6}$ to about $10^{-1}$ mole per mole of the organic silver salt component (a), and from about $10^{-5}$ mole to about $10^{-2}$ mole per mole of the silver halide.

The particle size of the thus obtained organic silver salt ranges from about 10 $\mu$ to about 0.01 $\mu$, and preferably from about 5 $\mu$ to about 0.1 $\mu$, in the length wise direction.

The photosensitive silver halide of component (b) used in the present invention can be silver chloride, silver bromide, silver iodide, silver chlorobromoiodide, silver chlorobromide, silver chloroiodide, silver iodobromide, or a mixture thereof.

The amount of the silver halide component (b) which can be used ranges from about 0.001 mole to about 0.5 mole, more preferably, from about 0.01 mole to about 0.3 mole per mole of the organic silver salt component (a).

These photosensitive silver halides can be those comprising coarse grains or fine grains. However, silver halides comprising very fine grains are particularly preferred.

A suitable grain size of the silver halide ranges from about 1 $\mu$ to 0.001 $\mu$, and more preferably from about 0.5 $\mu$ to about 0.01 $\mu$.

The photosensitive silver halide can be produced by various methods known in the photographic field such as a single jet method, a twin jet method, etc. For instance, a Lippmann method, an ammonia method, a ripening with thiocyanates or thioethers, etc., can be employed.

The silver halide emulsion which can be used in the present invention can be an emulsion rinsed with water, an alcohol, etc., to remove soluble salts or not rinsed.

The silver halide used in the present invention can be chemically sensitized with a reducing agent such as sulfur, selenium, a tellurium compound, gold, platinum, a palladium compound, stannous halide, or a mixture thereof, as described in U.S. Pat. Nos. 1,623,499, 2,399,083 and 3,297,447.

The light-sensitive silver halide emulsion used in the present invention preferably contains an anti-fogging stabilizing agent such as a thiazolium salt, an azaindene, a mercury salt, a urazole, a sulfocatechol, an oxime, a nitron, a nitroindazole, etc., to stablize the material against formation of fog, as described in U.S. Pat. Nos. 2,728,663, 2,839,405, 2,566,263 and 2,597,915 and British Patent 623,448.

These light-sensitive silver halide prepared in advance is then mixed with an oxidation-reduction composition comprising the organic silver salt component (a) and the reducing agent component (c) as described in U.S. Pat. No. 3,152,904. However, U.S. Pat. No. 3,457,075 discloses that this method does not result in a heat-developable light-sensitive material having sufficient light-sensitivity since the contact between the silver halide and the organic silver salt is not sufficient.

Accordingly, many attempts to increase the contact between the silver halide and the organic silver salt have been made.

One approach is to use a surface active agent as described in Japanese Patent Application 82852/73 and 82851/73.

In another approach, the silver halide produced in a polymer solution is mixed with the organic silver salt as described in U.S. Pat. Nos. 3,705,565, 3,713,833, 3,706,564, and 3,761,273, French Patent 2,107,162 and Belgian Patent 774,436.

The silver halide used in the present invention can be produced substantially at the same time with the formation the organic silver salt as described in Japanese Patent Application 65727/73, for example.

More specifically, for example, a mixture of a solution or a dispersion of the above described organic silver salt forming compound or a salt thereof and a compound (described hereinafter) which forms a light-sensitive silver halide is mixed with a solution of a silver salt such as silver nitrate, a silver complex salt, etc., or when a solution or dispersion of the organic silver salt forming compound or salt thereof is mixed with a solution of a silver salt such as silver nitrate, a silver complex salt, etc., a solution of a compound which forms the light-sensitive silver halide is added at the same time to produce the light-sensitive silver halide. Thus the silver halide is produced substantially at the same time as the formation of the organic silver salt.

Further, the light-sensitive silver halide used in the present invention can be produced by conversion of a part of the organic silver salt to a light-sensitive silver halide by applying a compound (described hereinafter) which forms the light-sensitive silver halide to a solution or dispersion of the previously prepared organic silver salt, or to a sheet material containing the organic silver salt. U.S. Pat. No. 3,457,075 discloses that the thus produced silver halide effectively contacts with the organic silver salt and provides a good effect.

The compound which forms the light-sensitive silver halide can include any compound which forms a silver halide on reacting with the organic silver salt. A simple test can be used to determine what compounds are effective. That is, to determine whether the compound will react to form the silver halide, the compound is reacted with the organic silver salt, and heated, if desired. Then, the product is examined by X-ray diffraction analysis to determine whether diffraction peaks typical to silver halide are observed or not.

Specific examples of compounds which can be used to form the light-sensitive silver halide include the following compounds.

1. Inorganic halides:

Halides represented by the formula $MX_n$, for example, wherein M represents a hydrogen atom, an ammonium group or a metal (e.g., lithium, sodium, potassium, rubidium, cesium, copper, gold, beryllium, magnesium, calcium, strontium, barium, zinc, cadmium, mercury, aluminum, indium, thallium, germanium, tin, lead, antimony, bismuth, chromium, molybdenum, tungsten, manganese, rhenium, iron, cobalt, nickel, ruthenium, rhodium, palladium, osmium, iridium, platinum, etc.) atom, X represents a chlorine, bromine or iodine atom and n is 1 when M is a hydrogen atom or an ammonium group, or n is the valence of the metal when M is a metal atom.

2. Halogen containing metal complexes:

$K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$, etc.

3. Onium halides:

Quaternary ammonium halides such as trimethylphenylammonium bromide, cetylethyldimethylammonium bromide, trimethylbenzylammonium bromide, etc., quaternary phosphonium halides such as tetraethylphosphonium bromide, etc., tertiary sulfonium halides such as trimethylsulfonium iodide, etc. These onium halides can be present in a final coating dispersion to decrease the sensitivity and, in some cases, the background density as described in U.S. Pat. No. 3,679,422.

4. Halogenated hydrocarbons:

Iodoform, bromoform, carbon tetrabromide, 2-bromo-2-methylpropane, etc.

5. N-halo compounds:

N-Halocompounds represented by the following formula (II) or (III)

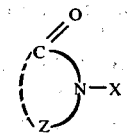

(II)

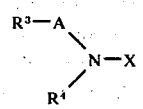

(III)

wherein X represents chlorine, bromine or iodine, Z represents an atomic group necessary to form a 5- to 7-membered ring, which 5- to 7-membered ring may further be condensed with another ring, A represents a carbonyl group or a sulfonyl group and $R^3$ and $R^4$ each represents an alkyl group, an aryl group or an alkoxy group. Examples of N-halo compounds are N-chlorosuccinimide, N-bromosuccinimide, N-bromophthalimide, N-bromoacetamide, N-iodosuccinimide, N-bromophthalazone, and N-bromooxazolinone, etc. These compounds are described in detail in Japanese Patent Applications 126658/73 and 19760/74. Further, N-halo benzotriazole and substituted benzotriazoles such as alkyl, nitro, halogen, imido or aminosubstituted benzotriazoles are also effective. In addition, N-bromo benzimidazoles are also suitable.

6. Other halogen containing compounds:

Triphenylmethyl chloride, triphenylmethyl bromide, 2-bromobutyric acid, 2-bromoethanol, dichlorobenzophenone, etc.

In the present invention, after the compound which forms the silver halide is added, the coating dispersion can be ripened by allowing the dispersion to stand for a suitable period (for example, about 20 min. to about 48 hours) at room temperature (about 20°–25° C) or at a higher temperature (about 30° to 80° C) to increase the sensitivity and decrease heat fog, or to improve other photographic characteristics.

The above described compounds which form the light-sensitive silver halide can be used individually or as a combination of two or more thereof. A suitable amount of these compounds is about 0.001 to about 0.5 mols, and preferably about 0.01 to about 0.3 mols per mole of the organic silver salt Component (a). If the amount is less than about 0.001 mol, the sensitivity is reduced. If the amount is more than about 0.5 mols, discoloration due light (undesirable coloration at the background area occurring when a processed light-sensitive material is allowed to stand under normal room illumination) increases.

The reducing agent Component (c) which can be used in the present invention is a reducing agent which has a reduction ability suitable for reducing the organic silver salt (Component (a)) when heated in the presence of the exposed silver halide.

The reducing agent which can be employed in selected depending on the organic silver salt with which it is used in combination.

Specific examples of reducing agents are substituted phenols, substituted or unsubstituted bisphenols, substituted or unsubstituted mono or bisnaphthols, di or polyhydroxybenzenes, di or polyhydroxynaphthalenes, hydroquinone monoethers, ascorbic acid and derivatives thereof, 3-pyrazolidones, pyrazolin-5-ones, reducing saccharides, p-phenylenediamines and derivatives thereof, reductones, kojic acid, hinokitiol, hydroxylamines, hydroxytetronic acid, hydroxytetronamides, hydroxamic acids, sulfhydroxamic acids, hydrazides, indan-1,3-diones, p-oxyphenylglycines, etc.

Of these reducing agents those which are photolytically decomposed as described in British Patent 1,163,187 are preferred.

Further, compounds which promote the photolysis can also be used together with the photolytically decomposeable reducing agent. For this purpose, blocked bisphenol reducing agents as described in U.S. Pat. No. 3,756,829 can be used quite advantageously. These types of compounds are described in, for example, U.S. Pat. No. 3,589,903, Japanese Patent Applications 81625/73 and 22135/74.

Examples of the reducing agents which can be used in the present invention are described in U.S. Pat. Nos. 3,152,904, 3,457,075, 3,531,286, 3,615,533, 3,679,426, 3,672,904, 3,751,252, 3,751,255, 3,782,949, 3,770,448, and 3,773,512, British Patent 1,338,427, and Belgian Patent 786,086.

Specific examples of reducing agents which can be used in the present invention are as follows:

1. Substituted phenols:

Aminophenols such as 2,4-diaminophenol, methylaminophenol, p-aminophenol, o-aminophenol, 2-methoxy-4-aminophenol, 2-β-hydroxyethyl-4-aminophenol, etc.; alkyl-substituted phenols such as p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol, p-octylphenol, etc.; aryl-substituted phenols such as p-phenylphenol, o-phenylphenol, α-phenyl-o-cresol, etc.; other phenols such as p-acetophenol, p-acetoacetyl-4-methylphenol, 1,4-dimethoxyphenol, 2,6-dimethoxyphenol, chlorothymol, 3,5-di-t-butyl-4-hydroxybenzyldimethylamine, sulfonamidephenols as described in German Patent Application (OLS) 2,336,395, novolak resins, that is, a reaction product of formaldehyde and a phenol derivative (e.g., 4-methoxyphenol, m-cresol, o- or p-t-butylphenol, 2,6-di-t-butylphenol, or a mixture thereof);

2. Substituted or unsubstituted bisphenols:

o-bisphenols such as 1,1-bis(2-hydroxy-3,5-dimethylphenyl)-3,5,5-trimethylhexane, bis(2-hydroxy-3-t-butyl-5-methylphenyl)methane, bis(2-hydroxy-3,5-di-t-butylphenyl)methane, bis(2-hydroxy-3-t-butyl-5-ethylphenyl)methane, 2,6-methylenebis(2-hydroxy-3-t-butyl-5-methylphenyl)-4-methylphenol, 1,1-bis(5-chloro-2-hydroxyphenyl)methane, 2,2'-methylenebis[4-methyl-6-(1-methylcyclohexyl)phenol], 1,1-bis(2-hydroxy-3,5-dimethylphenyl)-2-methylpropane, 1,1,5,5-tetrabis-(2-hydroxy-3,5-dimethylphenyl)-2,4-ethylpentane, 3,3',5,5'-tetramethyl-6,6'-dihydroxytriphenylmethane; p-bisphenols such as bisphenol A, 4,4'-methylenebis(3-methyl-5-t-butylphenol), 4,4'-methylenebis-(2,6-di-t-butylphenol), 3,3',5-,5'-tetra-t-butyl-4,4'-dihydroxybiphenyl, 4,4'-dihydroxybiphenyl, 1,1-bis(4-hydroxyphenyl)cyclohexane, 2,2-bis(3,5-dibromo-4-hydroxyphenyl)propane, 2,2-bis-(3,5-dimethyl-4-hydroxyphenyl)propane, 2,2-bis(3-methyl-4-hydroxyphenyl)propane, bis(3-methyl-4-hydroxy-5-t-butylphenyl)sulfide, 2,2-bis(4-hyroxy-3,5-di-t-butylphenylthio)propane, 4,4'-butylidenebis(6-t-butyl-3-methyl-phenol), 4,4'-thiobis(6-t-butyl-3-methylphenol), 4,4'-thiobis(6-t-butyl-2-methylphenol), 4,4'-butylidene-bis-(6-methylphenol), 4,4'-benzylidine-bis(2-tert-butylphenol), 4,4'-ethylidene-bis(6-tert-butyl-o-cresol), 4,4'-ethylidene-bis(2-tert-amylphenol), 4,4'-(p-chlorobenzylidene)di-(2,6-xylenol), 4,4'-ethylidene-bis(2-cyclohexylphenol), 4,4'-pentylidene-di(o-cresol), 4,4'-(p-bromo-benzylidene)-diphenol, 4,4'-propylidene-bis(2-phenylphenol), 4,4'-ethylidene-di-(2,6-xylenol), 4,4'-heptylidene-di(o-cresol), 4,4'-ethylidene-bis-(2,6-di-tert-butylphenol), 4,4'-(2-butenylidene)-di-(2,6-xylenol), 4,4'-(p-methylbenzylidene)di(o-cresol), 4,4'-(p-methoxybenzylidene)-bis-(2,6-di-tert-butylphenol), 4,4'-(p-nitrobenzylidene)-di(2,6-xylenol), 4,4'-(p-hydroxybenzylidene)-di-(o-cresol), etc.; others: polyphenols such as 3,5-di-t-butyl-4-hydroxybenzyldimethylamine, $\alpha,\alpha$-(3,5-di-t-butyl-4-hydroxyphenyl)dimethylether, 2,4,6-tris(3,5-di-t-butyl-4-hydroxybenzyl)phenol, N,N'-di(4-hydroxyphenyl)urea, tetrakis[methylene (3,5-di-t-butyl-4-hydroxyhydrocinnamate]methane, etc., diethylstilbestrol, hexestrol, bis(3,5-di-t-butyl-4-hydroxybenzyl)ether, 2,6-bis(2'-hydroxy-3'-t-butyl-5'-methylbenzyl)4-methylphenol, etc.

3. Substituted or unsubstituted mono or bisnaphthols and di or polyhydroxynaphthols:

bis-$\beta$-Naphthols such as 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl, etc.: naphthols such as $\alpha$-naphthol, $\beta$-naphthol, 1-hydroxy-4-amino-naphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxy-naphthalene, 1,4-dihydroxynaphthalene, methylhydroxynaphthalene, 1-amino-2-naphthol-6-sodium sulfonate, 1-naphthylamine-7-sulfonic acid, sulfonamidenaphthols as described in German Patent Application (OLS) 2,336,395.

4. Di- or polyhydroxybenzenes and hydroxymonoethers:

hydroquinone; alkyl-substituted hydroquinones such as methylhydroquinone, t-butylhydroquinone, 2,5-dimethylhydroquinone, 2,6-dimethylhydroquinone, t-octylhydroquinone, etc.; halogen-substituted hydroquinones such as chlorohydroquinone, dichlorohydroquinone, bromohydroquinone, etc.; alkoxy-substituted hydroquinones such as methoxyhydroquinone, ethoxyhydroquinone, etc.; other substituted hydroquinones such as phenylhydroquinone, hydroquinone monosulfonic acid salt, etc.; hydroquinone monoethers such as p-methoxyphenol, p-ethoxyphenol, hydroquinone monobenzylether, 2-t-butyl-4-methoxyphenol, 2,5-di-t-butyl-4-methoxyphenol, hydroquinone mono-n-propylether, hydroquinone mono-n-hexylether, etc.; others such as catechol, pyrogallol, resorcin, 1-chloro-2,4-dihydroxybenzene, 3,5-di-t-butyl-2,6-dihydroxybenzoate, 2,4-dihydroxybenzoate, 2,4-dihydroxyphenylsulfide, methyl gallate, propyl gallate, etc.

5.

Ascorbic acid and derivatives thereof:

l-Ascorbic acid; isoascorbic acid; monoesters of ascorbic acid such as ascorbic monolaurate, monomyristate, monopalmitate, monostearate or monobehenate, etc.; diesters of ascorbic acid such as ascorbic dilaurate, dimyristate, dipalmitate, or distearate, etc.; other ascorbic acid derivatives as described in U.S. Pat. No. 3,337,342.

6. 3-Pyrazolidones and pyrazolones:

1-Phenyl-3-pyrazolidone, 4-methyl-4-hydroxymethyl-1-phenyl-3-pyrazolidone, those described in British Patent 930,572, 1-(2-quinoly)-3-methyl-5-pyrazolone, etc.

7. Reducing saccharides:

Glucose, lactose, etc.

8. Phenylenediamines:

N,N-Dialkyl-p-phenylenediamines such as N', N'-diethyl-p-phenylenediamine, N-phenyl-N'-isopropyl-p-phenylenediamine, etc. In particular, color images can be obtained by using these reducing agents together with phenolic or active methylenic color couplers as described in U.S. Pat. No. 3,531,286. Similarly color images can be obtained by the method as described in U.S. Pat. No. 3,761,270.

9. Hydroxylamines:

N,N-Di(2-ethoxyethyl)hydroxylamine, etc.

10. Reductones

Anhydro-dihydro-aminohexose reductones as described in U.S. Pat. No. 3,679,426, linear-aminoreductones as described in Belgian Patent 786,086, etc.

11. Hydroxamic acids:

Hydroxamic acid as described in U.S. Pat. Nos. 3,751,252 and 3,751,255, etc.

12. Hydrazides:

Hydroxy-substituted aliphatic acid arylhydrazides as described in U.S. Pat. No. 3,782,949, etc.

13. Others:

Pyrazolin-5-ones as described in U.S. Pat. No. 3,770,448, indan-1,3-diones having at least one hydrogen atom at the 2-position as described in U.S. Pat. No. 3,773,512, amidoximes as described in U.S. Pat. No. 3,794,488, further, reducing agents as described in U.S. Pat. No. 3,615,533 and German Patent Application (OLS) 2,031,748 can also be used.

A particularly preferred reducing agent used for the present invention is at least one selected from the group consisting of (1) esters of carboxylic acids derived from phenols having a substituent in at least one ortho position and mono- or polyhydric alcohols or phenols and (2) esters of alcohols derived from polyhydric phenols having a substituent in at least one ortho position or esters of phenols substituted with a bulky substituent in at least one ortho position and mono- or polycarboxylic acids.

Of these reducing agents, those having an alkyl group such as methyl group, a ethyl group, a propyl group, an isopropyl group or a butyl group or an acyl group on at least one of the ortho positions to the hydroxyl group substituted on an aromatic nucleus are especially preferred. These reducing agents are stable to light, and accordingly, provide less light discoloration.

Examples of these reducing agents are mono-, bis-tris- or tetrakis-phenols substituted with a 2,6-di-t-butyl-phenol group.

More specific examples of these preferred by the following formulae:

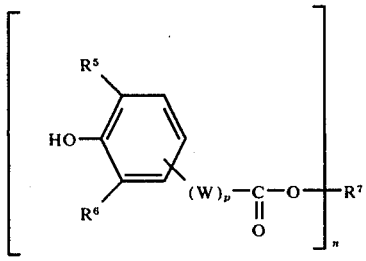

or

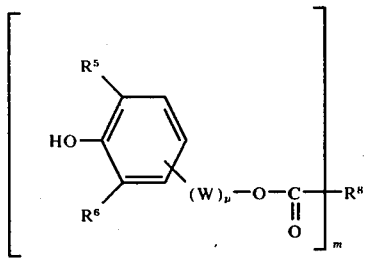

wherein p is 0 or 1, W represents a divalent bonding group containing 30 carbon atoms or less; $R^5$ represents an alkyl group having 1 to 20 carbon atoms; $R^6$ represents a hydrogen atom or an alkyl group, which alkyl group may be the same as or different from $R^5$; $R^7$ is an alcohol residue; $R^8$ is a carboxylic acid residue; and m and n are integers equal to the number of alcohol groups and carboxylic acid groups esterified respectively. For example, tetrakis-methylene [(3,5-di-tert-butyl-4'-hydroxylhydrocinnamate)] methane octadecyl-3-(3',5'-di-tert-butyl-4'-hydroxyphenyl) propionate, etc., can be used.

Those esters as described above which provide high image density and a desirable black color tone in combination with phthalazinone, which can be added to the composition of the present invention as a particularly suitable activator and toning agent, described hereinafter, are represented by the following general formula

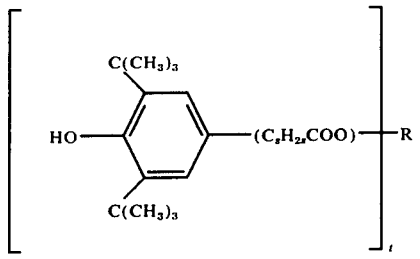

wherein *s* is 1, 2, 3 or 4, R is a residue of a saturated non-cyclic aliphatic alcohol represented by the formula $$C_dH_{2d-2-t}$$

wherein *d* is an integer of 1 to 6 and *t* is an integer of greater than 1 and less than 4*d*.

Further, photodecomposable reducing agents such as ascorbic acid or the derivatives thereof, furoin, benzion, dihydroxyacetone, glyceraldehyde, tetrahydroxyquinone rhodizonate, 4-methoxy-1-naphthol are also suitable, since these reducing agents are decomposed by light when the light-sensitive material is allowed to stand in light room after development, and reduction does not proceed further. Thus discoloration by light is prevented.

In addition, positive images can be directly obtained by imagewisely exposing and decomposing the reducing agent as described in Japanese Patents 22185/70 and 41865/71.

These reducing agents can be used individually or as a combination of two or more thereof. Examples of combinations of two reducing agents are described in Japanese Patent Application 27242/73, U.S. Pat. Nos. 3,667,958 and 3,751,249.

Further, it has been determined that development is promoted by using a tin, iron, cobalt or nickel compound together with the reducing agent.

The selection of the preferred reducing agents depends on the organic silver salt (Component (a)) with which the reducing agent is to be combined. For example, stronger reducing agents are suitable for silver salts which are comparatively difficult to reduce, such as silver behenate or silver benzotriazole, and weaker reducing agents are suitable for silver salts which are comparatively easy to reduce, such as silver caprate or silver laurate. That is, once the organic silver salt is established, a suitable reducing agent can be selected depending on the organic silver salt.

Examples of reducing agents suitable for silver benzotriazole are naphthols such as 1-phenyl-3-pyrazolidones, ascorbic acid, monocarboxylic acid esters of ascorbic acid, 4-methoxy-1-naphthols, etc.; for silver behenate, o-bisphenols, hydroquinones and many others and for silver caprate or silver laurate, p-bisphenols such as substituted tetrakisphenols, substituted bisphenol A, etc., p-phenylphenols, etc.

The amount of the above described reducing agents can not be set forth unequivocally, because the amount generally depends on the combination of the organic silver salt, the reducing agent and other components present. However, a range of about 0.05 to about 10 mols, more preferably about 0.1 to about 3 mols, of the reducing agent per mole of the organic silver salt is suitable.

Ensuring the reducing agent is appropriate can be facilitated by using two or more reducing agents at one time. For instance, in using two or more reducing agents in combination, weak reducing agents for the organic silver salt (a so-called "main reducing agent"), which is not sufficient to achieve an appropriate image density in the image areas when used alone, and strong reducing agents for the organic silver salt (a so-called "auxiliary reducing agent"), which cause fog in non-image areas when used alone, are employed in combinations thereof to achieve the benefits of both and provide a good image.

The amount of an auxiliary reducing agent which can be used in the present invention as a reducing agent used together with the main reducing agent can be varied broadly depending on the reducing ability of the auxiliary reducing agent and the redicibility of the organic silver salt. However, in general, a range of about $10^{-5}$ to about 1 mole, more preferably $10^{-3}$ to 0.8 mols, per mole of the main reducing agent is suitable.

Another effective combination of reducing agents is to use 0- or p-bisphenols together with at least one carboxylic acid ester derived from a phenol having a bulky substituent in at least one of the ortho positions such as an ester of a carboxylic acid derived from a phenol having a bulky substituent in at least one of the ortho positions and a mono- or polyhydric alcohol or a phenol, or an ester of a polyhydric phenol having a bulky substituent in at least one of the ortho positions or an alcohol derived from a phenol having a bulky substituent in at least one of the ortho positions and a mono or polycarboxylic acid.

By using these combinations a decrease in the heat fog, and an increase in the whiteness and light stability after processing can be obtained.

Suitable additives can also be incorporated in the heatdevelopable light-sensitive materials of this invention.

A toning agent can suitably be used as an additive in combination with these reducing agents.

The toning agent is preferably used when a dense, especially black, image is desired.

The amount of the toning agent is about 0.0001 to about 2 mols, preferably about 0.005 to about 1 mol per mol of the organic silver salt.

The toning agents effective in the present invention differ depending on the organic silver salt and the reducing agent used, however, those generally used in the present invention include heterocyclic organic compounds containing at least two heteroatoms and having at least one nitrogen atom in the heterocyclic ring as described in U.S. Pat. No. 3,080,254.

Substituted phthalazinones such as phthalazone (phthalazinone), phthalic anhydride, 2-acetylphthalazinone, 2-phthalylphthalazinone and those described in Japanese Patent Application 116022/73 can be suitably used for the present invention.

Examples of other effective toning agents are pyrazolin-5-ones, cyclic imides, and quinazolinones as described in Japanese Patent Application (OPI) 6077/71. Examples of these compounds are phthalimide, N-hydroxyphthalimide, N-potassium phthalimide and N-silver phthalimide, etc.

Silver phthalazinone is also effective as a toning agent.

Still other toning agents include mercapto compounds as described in Japanese Patent Applications 41967/72 and 41969/72, oxazinediones as described in Japanese Patent Application 50427/73, phthalazinediones as described in Japanese Patent Application 116471/73, uracils as described in Japanese Patent Application 18378/49, N-hydroxynaphthalimides as described in U.S. Pat. No. 3,782,941, substituted phthalimides as described in German Patents (DAS) 2,140,406, 2,141,063 and 2,220,597, phthalazinone derivatives as described in German Patent Application (OLS) 2,220,618.

The components used in the invention can be included in a support (e.g., if suitable impregnated therein) or in a binder layer or layers thereon. Further each component can be individually present each in a different binder layer where two or more binder layers are coated on a support, combinations of some of the components can be employed in one binder layer and the remaining components contained in another binder layer, or some of the components used in the invention can be present in the support while the other components are present in a binder layer or layers. Further in certain instances the components such as the reducing agent, etc. have the ability to per se function as a binder, and in these cases, if desired the binder component need not be employed on a support.

A hydrophobic binder is, in general, preferred for the present invention, however, a hydrophilic binder can also be used. Preferred binders are those which are transparent or semi-transparent.

Examples of suitable binders include natural materials such as proteins (e.g., gelatin, gelatin derivatives, etc.), polysaccharides (e.g., cellulose derivatives, dextrans, etc.), gum arabic, etc. especially latex-like vinyl compounds and the following synthetic polymers which increase the dimensional stability of the photographic material.

Suitable examples of synthetic polymers are those described in U.S. Pat. Nos. 3,142,586, 3,193,386, 3,062,674, 3,220,844, 3,287,289, and 3,411,911. Effective polymers are water-insoluble polymers such as alkylacrylates, alkylmethacrylates, acrylic acid, sulfoalkylacrylates, sulfoalkylmethacrylates, etc., those containing cyclic sulfobetaine units, etc.

Specific examples of polymers and resins are polyvinyl butyral, polyacrylamide, cellulose acetate butyrate, cellulose acetate propionate, polymethylmethacrylate, polyvinylpyrrolidone, polystyrene, ethyl cellulose, polyvinyl chloride, rubber chloride, polyisobutylene, butadiene-styrene copolymers, vinyl chloride-vinyl acetate copolymers, vinyl chloride-vinyl acetate-maleic acid terpolymers, polyvinyl alcohol, polyvinyl acetate, benzyl cellulose, cellulose acetates, cellulose propionate, and cellulose acetate phthalate. These binders can be used individually or, if desired, as a mixture of two or more thereof.

A preferred ratio by weight of the binder to the organic silver salt of Component (a) ranges from about 10:1 to about 1:10 and preferably about 4:1 to about 1:4.

The layer containing each component and other layers used in the present invention and described in the specification can be coated on various kinds of supports.

Examples of supports which can be used for the present invention include synthetic resin films such as cellulose nitrate films, cellulose ester films and partially acetylated cellulose ester films, polyvinyl acetal films, polyethylene films, polyethylene terephthalate films, polycarbonate films, etc., glass, paper, and metals such as aluminum, etc. Further, baryta paper, resin coated paper and water resistant paper can also be used.

Flexible supports are preferred for ease of handling.

Preferred paper supports include clay-processed paper such as art paper, coat paper, etc. Also, sizing processed papers using polysaccharides are suitable.

A preferred amount of silver arising from the both the organic silver salt and the silver halide coated on the support ranges from about 0.2 to about 3 g and preferably about 0.3 to about 2 g per $m^2$ of the support. If the amount is less than about 0.2 g of silver per $m^2$, a sufficient image density can not be obtained. If the amount is higher than about 3 g of silver per $m^2$, the photographic properties are not additionally improved while the cost increases.

Some spectral sensitizing dyes which have been hitherto useful for sensitizing a gelatin silver halide emulsion can be advantageously used in order to further enhance the sensitivity of the heat-developable light-sensitive material of the present invention.

Examples of effective spectral sensitizers are cyanine dyes, mercyanine dyes, complex (trinuclear or tetranuclear) cyanine dyes, holopolar cyanine dyes, styryl dyes, hemicyanine dyes, oxonol dyes, hemioxonol dyes, etc. Particularly, cyanine dyes containing basic nuclei such as thiazoline, oxazoline, pyrroline, pyridine, oxazole, thiazole, selenazole, imidazole, etc., are preferred. These nuclei can contain alkyl groups, alkylene groups, hydroxyalkyl groups, sulfoalkyl groups, carboxyalkyl groups, aminoalkyl groups, or enamine groups, which can form condensed carbon rings or complex rings, as substituents. Symmetric or asymmetric cyanine dyes can be used. Further, cyanine dyes having alkyl groups, phenyl groups, enamine groups, or heterocyclic ring substituents on methine chains or polymethine chains can be used. Particularly, cyanine dyes containing carboxy groups are effective for sensitization.

Merocyanine dyes can contain, in addition to the above described basic nuclei, acidic nuclei such as thiohydantoin nuclei, rhodanine nuclei, oxazolidinedione nuclei, thiazolidinedione nuclei, barbituric acid nuclei, thiazolidone nuclei, malononitrile nuclei, and pyrazolone nuclei. These acidic nuclei can be further substituted with alkyl groups, alkylene groups, phenyl groups, carboxyalkyl groups, sulfoalkyl groups, hydroxyalkyl groups, alkoxyalkyl groups, alkylamine groups, or heterocyclic nuclei. Particularly, merocyanine dyes containing imino groups or carboxyl groups are effective for sensitization.

These sensitizers can be used individually or as a combination of two or more thereof, if desired.

Further, supersensitizing agents which do not absorb visible light such as ascorbic acid derivatives, azindenes, cadmium salts, organic sulfonic acids, etc., as described in U.S. Pat. Nos. 2,933,390 and 2,937,089 can be employed.

Examples of sensitizers which are particularly effective for sensitizing the heat-developable photosensitive material of the present invention include merocyanine dyes containing rhodanine nuclei, thiohydantoin nuclei, or 2-thio-2,4-oxazolidinedione nuclei as described in Japanese Patent Application (OPI) 6329/72, for example, 3-p-carboxyphenyl-5-[β-ethyl-2-(3-benzooxazolylidenyl)ethylidenyl]rhodanine, 5-[(3-β-carboxyethyl-2-(3-thiazolinylidenyl)ethylidenenyl]-3-ethyl rhodanine, 3-carboxymethyl-5-[(3-methylthiazolinylidenyl)-α-ethylethylidenyl]rhodanine, 1-carboxy-methyl-5-[(3-ethyl-2-(3H)-benzooxazolydidenyl-)ethylidenyl]-3-phenyl-2-thiohydantoin, 5-[(3-ethyl-2-benzooxazolinidenyl)-1-methylethylidenyl]-3-[(3-pyrrolin-1-yl)propyl]rhodanine, and 3-ethyl-5-[(3-ethyl-2-(3H)-benzothiazolylidenyl)isopropylidenyl]-2-thio-2,4-oxazolidinedione. Further, trinuclear merocyanine dyes as described in U.S. Pat. 3,719,495, polycyclic aromatic dyes as described in Belgian Pat. 788,695, sensitizing dyes mainly used for silver bromide as described in Japanese Patent Application 56332/72, styrylquinoline dyes as described in Japanese Patent Application 127999/72, rhodacyanine dyes as described in Japanese Patent Application 14916/73, acid dyes such as 2′, 7′-dichlorofluorescein, etc., as described in Japanese Patent Applications 7624/73, 12587/73, 50903/73 and 81550/73, and merocyanine dyes as described in Japanese Patent Applications 9565/74 and 10815/74, etc., can also be used for the present invention.

Specific preferred examples of merocyanine dyes containing a pyrazolone nucleus are as follows.

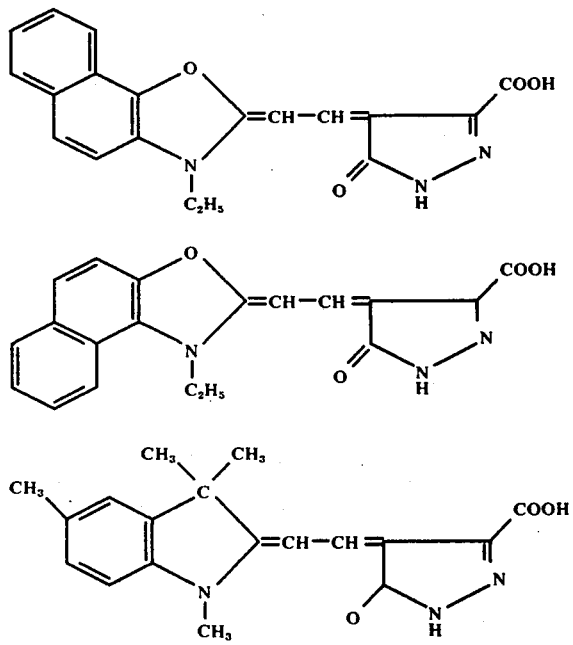

-continued

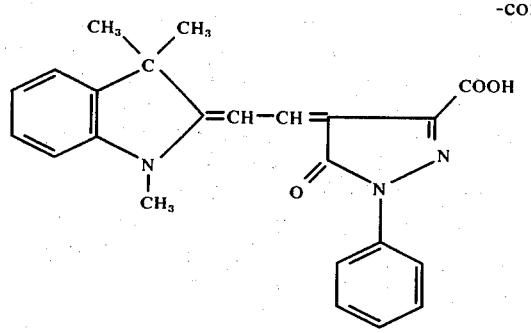

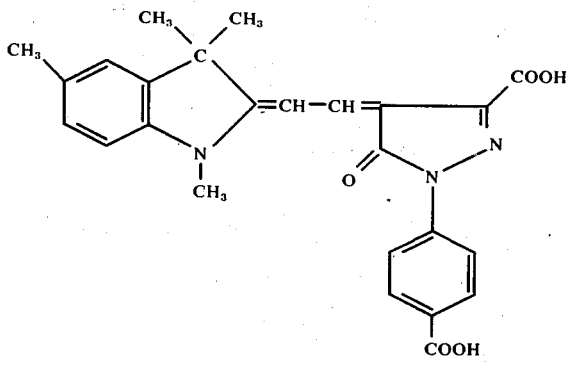

These dyes can be used in an amount of about $10^{-4}$ to about 1 mol per mol of the silver halide of Component (b) or the silver halide forming compound.

The heat-developable light-sensitive material of the present invention can have an antistatic layer or a electro-conductive layer. These layers can contain soluble salts such as halides and nitrates, ionic polymers as described in U.S. Pat. Nos. 2,861,056 and 3,206,312, and insoluble inorganic salts as described in U.S. Pat. No. 3,428,451. Also, a vacuum evaporated metal layer can be employed.

If desired, the heat-developable light-sensitive material of the present invention can contain an antihalation material or antihalation dyes.

Heat decolorizable dyes are preferred. For example, those described in U.S. Pat. Nos. 3,769,019; 3,745,009 and 3,615,432 are preferred. Further, filter dyes or light absorbing materials as described in U.S. Pat. Nos. 3,253,921; 2,527,583 and 2,956,879 can be present.

The heat-developable light-sensitive material of the present invention can, if desired, contain a matting agent such as starch, titanium dioxide, zinc oxide, silica, polymer beads including beads as described in U.S. Pat. Nos. 2,922,101 and 2,761,245, alumina, kaolin, clay, etc.

The heat-developable light-sensitive material of the present invention can further contain fluorescent brightening agent such as stilbenes, triazines, oxazoles, and coumarins, etc., as described in German Patents 972,067 and 1,150,274, French Patent 1,530,244, U.S. Pat. Nos. 2,933,390 and 3,406,070.

These fluorescent brightening agents can be used as an aqueous solution or a dispersion.

The heat-developable light-sensitive material used in the present invention can further contain a plasticizer or a lubricating agent.

Suitable examples of plasticizers or lubricating agents are glycerin, diols, polyalcohols as described in U.S. Pat. No. 2,960,404, for example, fatty acids or esters thereof as described in U.S. Pat. Nos. 2,588,765 and 3,121,060, silicone resins as described in British Patent 955,061, for example, etc.

Further, the heat-developable light-sensitive material of the present invention can contain a surface active agent, for example, saponin or alkylarylsulfonates as described in U.S. Pat. No. 2,600,831, amphoteric compounds as described in U.S. Pat. No. 3,133,816, and addition products of glycidols and alkylphenols. etc.

Any layer of the heat-developable light-sensitive material of the present invention which is capable of being hardened can be hardened by various organic or inorganic hardening agents.

These hardening agents can be used individually or as a combination of two or more thereof.

Examples of suitable hardening agents are aldehydes, blocked aldehydes, ketones, derivatives of carboxylic acids and carbonyl acids, sulfonate esters, sulfonyl halides and vinyl sulfonyl esters, active halogen containing compounds, epoxy compounds, aziridine, active olefin containing compound, isocyanates, carbodiimides, polymeric hardening agents such as dialdehyde starch, etc.

Further, various additives to increase the optical density of the images obtained can be present. Compounds containing $$-\underset{\underset{O}{\|}}{C}-,\quad -\underset{\underset{O}{\|}}{S}-,$$

or $-SO_2-$ groups, for example, non-aqueous polar organic solvents such as tetrahydrothiophene-1,1-dioxide, 4-hydroxybutanoic acid lactone methylsulfinylmethane as described in U.S. Pat. No. 3,667,959. In addition, acetates of zinc, cadmium and copper as described in U.S. Pat. No. 3,708,304 are suitable. Further, compounds which become alkaline on heating such as water of crystallization containing compounds, acid salts of amines, and metal oxides or hydroxides as described in Japanese Patent Publication Nos. 26582/69 and 18416/70 are effective to promote development. Further, a combination of polyalkylene glycols and mercaptotetrazole can be used to increase the sensitivity, contrast and image density as described in U.S. Pat. No. 3,666,477.

Various methods can be employed to prevent heat fog of the heat-developable light-sensitive material of the present invention. One method is to use the mercury compounds as described in Japanese Patent Publication No. 11113/72. Also, direct positive images can be obtained using mercury compounds as described in U.S. Pat. No. 3,589,901. Further, stable color images can be obtained using a combination of a mercury compound and a color forming coupler as described in U.S. Pat. No. 3,764,328. Further, a method in which the heat-developable light-sensitive material is stabilized to light before heating and becomes light-sensitive by pre-heating before image exposure can be employed by using mercury compounds or certain N-halo compounds as described in Japanese Patent Applications (OPI) 51626/73, 80030/73, 89720/73 and 10039/74, and German Patent Application (OLS) 2,315,233. Further, the sensitivity or image contrast of the heat-sensitive light-sensitive material can be changed by heating before image exposure.

A second method to prevent heat fog is to use N-halo compounds such as N-halosuccinimides, N-haloacetamides, etc., as described in Japanese Patent Application (OPI) 10724/74 and Japanese Patent Applications 8194/73 and 2842/73. N-halo compounds such as N-halo oxazolinones, N-halo benzotriazoles, N-halo-benzimidazoles, etc., can also be used.

Another method to prevent heat fog involves using higher fatty acids such as lauric acid, myristic acid, palmitic acid, stearic acid, behenic acid, etc., tetrahalophthalic acids or the anhydrides thereof, arylsulfonic acids such as benzensulfonic acid or p-toluenesulfonic acid, etc., arysulfinic acids such as benzenesulfinic acid or p-toluenesulfinic acid, etc., or salts thereof, lithium salts of higher fatty acids such as lithium myristate, lithium stearate, lithium behenate, lithium laurate, etc., and acid stabilizing agents as described in U.S. Pat. No. 3,645,739, Japanese Patent Applications 37965/73, 43935/73 and 106724/73, Japanese Patent Application (OPI) 89720/73. Other acid stabilizing agents include salicylic acid, p-hydroxybenzoic acid, tetrabromobenzoic acid, tetrachlorobenzoic acid, p-acetamidebenzoic acid, alkyl-substituted benzoic acids such as p-t-butyl benzoic acid, etc., phthalic acid, isophthalic acid, tri-mellitic acid, pyromellitic acid, diphenic acid, 5', 5'-methylenebissalicylic acid are also effective. These acid stabilizing agents can be used not only to prevent heat fog but also to prevent light-discoloration under normal room illumination after processing, to increase the image density and to improve the shelf life (the ability of the photographic material to maintain those photographic properties possessed immediately after production after storage) of the photographic material.

Other compounds which are effective for preventing heat fog include benzotriazole and derivatives thereof, mercapto compounds such as 1-phenyl-5-mercaptotetrazole, etc., azolethioethers or blocked azolethiones, and peroxides or persulfates as described in Japanese Patent Application 5453/74, etc.

Further, during or before preparation of the silver halide, the presence of a chromium salt, a rhodium salt, a copper salt, a nickel salt, a cobalt salt, or a complex salt of rhodium, iron or cobalt is effective for improving photographic properties such as heat fog and sensitivity.

To prevent light discoloration (a phenomenon in which the non-exposed area of the light-sensitive material is gradually discolored by light under normal room illumination after processing) of the processed heat-developable light-sensitive material of the present invention, stabilizing agent precursors such as azolethioethers or blocked azolethiones as described in Japanese Patent Application (OPI) 318/72, tetrazolylthio compounds as described in U.S. Pat. No. 3,700,457 or light-sensitive organic oxidizing agents containing halogens as described in U.S. Pat. No. 3,707,377, can be used.

Further, light absorbing dyes as described in Japanese Patent 33692/73 can be used to increase the resolving power of the light-sensitive material especially film type light-sensitive materials.

The leuco dye compounds as described in Japanese Patent Application 110287/73 can be also used to improve the shelf life of the heat-developable light-sensitive material of the present invention.

Further, it is possible to overcome the amount of color dye remaining and increase the whiteness by bluing, for example, by using blue dyes such as Victoria Blue.

If desired, the processed light-sensitive material can be stabilized to light and heat. Effective stabilizing methods include those using an aqueous solution containing a mercapto compound as described in U.S. Pat. No. 3,617,289 and applying a laminate containing a stabilizing agent as described in Japanese Patent Application 102337/73.

If desired, an overcoating polymer layer can be formed on the light-sensitive layer to increase the transparency of the heat-developable light-sensitive layer and accordingly to increase the image density and to improve the shelf life of the light-sensitive material as described in Japanese Patent Application (OPI) 6917/74.

A suitable thickness of the overcoating polymer layer ranges from about 1 to 20 $\mu$.

Suitable examples of polymers which can be used in the overcoating layer are polyvinyl chloride, polyvinyl acetate, vinyl chloride/vinyl acetate copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate, polyvinyl pyrrolidone, etc. Further, the addition of kaolin, silica, or polysaccharides such as starch, etc., in the overcoating polymer layer as described in Belgian Patent 798,367 and Japanese Patent Application 97050/73 renders the material capable of being written upon with a ball point pen or a pencil. In the overcoating polymer layer, filter dyes, ultraviolet light absorbing agents and acid stabilizing agents such as higher fatty acids can be employed.

The heat-developable light-sensitive material of the present invention can contain an undercoating layer between the support and the heat-developable light-sensitive layer. Various polymers already described can be used as binders of the undercoating layer. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, rubber chloride, polyisobutylene, butadiene/styrene copolymers, vinyl chloride/vinyl acetate copolymers, vinyl chloride/vinyl acetate/maleic acid copolymers, polyvinyl alcohol, polyvinyl acetate, cellulose acetate, cellulose propionate, cellulose acetate phthalate, gelatin, derivatives of gelatin, polysaccharides, etc. Fatty acids or metal salts of fatty acids can be present in the undercoating layer to improve the photographic properties of the light-sensitive material of the present invention such as light discoloration and heat fog. Further, pigments such as clay, etc., can be present in the undercoating layer to prevent penetration of the solvents into the support. Further, a matting agent such as alumina, starch, silica, kaolin, titanium dioxide, or zinc oxide, etc., can be present in the undercoating layer. The undercoating layer can be an electroless deposited layer of an electroconductive metal as described in U.S. Pat. No. 3,748,137.

Further, by coating, preferably an oleophilic polymer layer on the back surface of the support, the moisture resistance is increased and curling is prevented when paper is used as a support.

The heat-developable light-sensitive layer, the overcoating polymer layer, the undercoating layer, the backing layer and other layers of the present invention can be coated using various methods. Examples of suitable methods include a dip coating method, an air-knife coating method, a curtain coating method and a hopper coating method. If desired, two or more layers can be coated at the same time as described in U.S. Pat. No. 2,761,791 and British Patent 837,095. Alternatively, impregnation of one or more components into the support can be accomplished by a dip coating method.

In general, the photographic properties of the heat-developable light-sensitive material as of the present invention are easily degraded by moisture. Therefore, it is preferred to include a drying agent for the composition as described in Japanese Patent Application 50429/73, when the coated light-sensitive material is packaged for the trade.

The thus obtained heat-developable light-sensitive material is cut to a size suitable for use, and then subjected to image exposure. As was already described, a preheating (at about 80° C to 140° C) can be employed before image exposure.

Suitable light sources for image exposure include a tungsten lamp, a fluorescent copy lamp mainly used for exposure of diazo light-sensitive materials, a mercury lamp, a xenon lamp, a cathode ray tube, and a laser, etc.

Photographic images having a continuous tone as well as line images such as drawings can be used as originals. Further, pictures of people and scenes can be directly obtained using a camera. Contact printing, reflection printing, or enlarging printing can be used.

The amount of image exposure depends on the sensitivity of the light-sensitive material, and about 10 lux·sec is required for a high speed light-sensitive material and about $10^4$ lux·sec for a low speed light-sensitive material.

The thus image exposed light-sensitive material can be developed by simply heating (about 80° C to about 180° C and preferably about 100° C to about 150° C). A suitable developing time is about 1 second to 60 seconds. The developing time depends on the temperature at heating, and usually about 5 seconds to about 40 seconds at 120° C, about 2 seconds to about 20 seconds at 130° C and about 1 second to about 10 seconds at 140° C are suitable.

Many heating means can be utilized for heat developing the light-sensitive materials of the present invention, for example, the light-sensitive materials can be contacted with a simple heated plate or contacted with a heated drum, or they can be passed through a heated space. Further, they can be heated using high frequency or a laser beam.

A deodorizer can be included in a processor to remove any odor generated by heating. Also, certain kinds of perfumes can be present in the material so that the odor of the light-sensitive material is not noticed.

Methods for specifically preparing the heat-developable light-sensitive material of the present invention are described in detail in the Examples. However, the procedures employed can be briefly described as follows. That is, the organic silver salt is prepared by reacting an organic silver salt forming compound with a silver ion donating compound, such as silver nitrate, using various methods described already. The preparation is usually carried out at atmospheric pressure, and at a temperature of about −15° C to +80° C. A suitable temperature usually ranges from about 20° C to about 60° C. The thus prepared organic silver salt is rinsed with water, an alcohol, etc., and then dispersed in a binder to form an emulsion. A colloid mill, a mixer, or a ball mill, etc., can be used for dispersion. The dispersing is usually carried out at room temperature (about 15° C to 25° C). Into the thus obtained polymer dispersion of the silver salt, a silver halide forming compound is added to convert a part of the organic silver salt to silver halide. A suitable reaction temperature is from room temperature to about 80° C. A suitable reaction time is about 1 minute to about 48hours. As was already described, a previously prepared silver halide can be employed, or the silver halide can be prepared at the same time with the organic silver salt. Then, various additives such as sensitizing dyes, reducing agents, toning agents, etc., are added successively, preferably as solutions. Usually, these additives are added successively into the dispersion with stirring at a temperature of room temperature to 50° C, with a suitable time interval (usually about 5 to 20 minutes) there between. Thus a coating solution is obtained after all of the additives are added. The thus-obtained coating solution is coated on a suitable support. A suitable temperature for the coating is about 5° C to 50° C. A suitable drying temperature is about 3° C to 100° C. A suitable coating rate is about 3 m/min. to 150 m/min. Then, if desired, a top coat polymer layer can be coated in a similar manner. Further, an undercoat layer can be coated before the other coating solutions are coated, or a back coat layer can be coated in a similar manner, or these two layers can be coated at the same time.

The heat-developable light-sensitive material of the present invention has a particularly low heat-fogging property and high photographic sensitivity.

The present invention will be further illustrated by reference to the following examples. Unless otherwise indicated, all parts, percents, ratios and the like are by weight.

EXAMPLE 1

A solution of 12 g of lauric acid in 100 ml of toluene was added to a solution of 1.9 g of sodium hydroxide in 100 ml of water at a temperature of 25° C and mixed to form an emulsion. Then, an aqueous solution of 8.5 g of silver nitrate in 50 ml of water was added thereto. The mixture was allowed to stand for 5 minutes to separate into a toluene phase containing silver laurate and an aqueous phase. After the aqueous phase was removed by decantation, 200 ml of ethanol was added to the toluene phase for dispersion, and then silver laurate was separated by centrifugation. 12 g of spindle-shaped silver laurate crystals having a major diameter of about 3 $\mu$ was obtained.

6 g of the thus obtained silver laurate (an amount of about 0.02 mol) and 12 g of polyvinyl butyral were added to 70 g of ethyl alcohol and the mixture was dispersed using a mixer to produce a polymer dispersion of the silver salt.

To this polymer dispersion of the silver salt, 0.15 g of N-bromoacetamide (silver halide forming component) was added and further 5 ml of a methyl Cellosolve solution of 2-thiouracil at a concentration of 0.1% by weight was added while stirring the mixture with a stirrer at a temperature of 50° C, and then the mixture was heated for 90 minutes.

Then the mixture was cooled to 30° C and the following components were successively added to the mixture at time intervals of 5 minutes while stirring to produce a coating solution.

| | | |
|---|---|---|
| (1) | Sensitizing Dye* (0.025% by weight ethyl Cellosolve solution) | 10 ml |
| (2) | Lauric Acid (acid stabilizing agent) (3% by weight methyl Cellosolve solution) | 35 ml |
| (3) | Phthalazone (toning agent) (3% by weight methanol solution) | 50 ml |
| (4) | 2,2-bis(3,5-Dimethyl-4-hydroxyphenyl)-propane (reducing agent) (20% by weight acetone solution) | 30 ml |
| (5) | Thiouracil (0.1% by weight methyl Cellosolve solution) | 5 ml |

* a merocyanine dye represented by the following formula

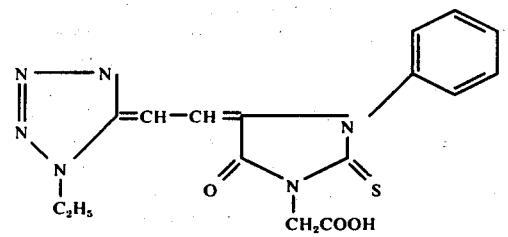

The thus-obtained coating solution was coated on an art paper support in a coverage of 0.3 g of silver per $m^2$ of the paper, and on a polyethylene terephthalate film support in a coverage of 1.5 g of silver per $m^2$ of the film, and then dried.

The sample prepared using the art paper was designated Sample A, and using the polyethylene terephthalate film was designated Sample A' (hereinafter, in the following examples, sample symbols without the prime designation are samples prepared using paper supports and the sample symbols with the prime designation are samples prepared using synthetic resin film supports).

Further, on the coated layer of Sample A, an ethanol solution of ethyl cellulose at a concentration of 10% by weight having silica dispersed therein was overcoated to obtain a topcoat polymer layer (the amount of the silica was 0.1 that of the ethyl cellulose) at a thickness of about 1.5 $\mu$, and on the coated layer of Sample A' a tetrahydrofuran solution of a vinyl chloride/vinyl acetate copolymer (monomer molar ratio: 85:15 by weight) at a concentration of 15% by weight was overcoated to obtain a top-coat polymer layer at a thickness of about 3 $\mu$.

As comparative samples the same heat-developable light-sensitive materials (Samples B and B') as those (Samples A and A') except omitting Component (5) of the present invention were produced.

The thus obtained heat-developable light-sensitive materials (Samples A,A', B and B') were exposed to light through an original having gradation using a tungsten lamp (exposure amount) 3,000 lu·sec), and then heated to 120° C for 30 seconds.

The photographic properties obtained for the images after development are shown in Table 1 below.

The image densities of Samples A and B are reflection densities and those of Samples A' and B' are transmission densities. (hereinafter the same)

Table 1

| | Sample | | | |
|---|---|---|---|---|
| | A | A' | B | B' |
| Sensitivity | 3.3 | 3.5 | 1.0 | 1.0 |
| $D_{max}$ | 1.5 | 1.95 | 1.50 | 1.95 |
| Fog | 0.20 | 0.15 | 0.48 | 0.52 |

(Remarks)
The measured values of sensitivity are relative to the sensitivities of Samples B and B'. That is, the sensitivities of Samples B and B' which do not contain 2-thiouracil were designated 1.0, and those of Samples A and A' were 3.5 times of the former respectively. The sensitivity values given hereinafter were also determined in the same way.

From the above results, the sensitivities of Samples A and A' which contain 2-thiouracil were increased by a factor of 3.5 in comparison with Samples B and B' which did not contain 2-thiouracil. Also, the heat fog of Samples A and A' was lower than that of Samples B and B', therefore the effect of 2-thiouracil is evident.

Here, in this example, 2-thiouracil was added twice, that is, first when N-bromacetamide was added and second after the reducing agent was added. It has been found that, an increase of sensitivity is provided by adding 2-thiouracil when N-bromacetamide is added, that is, mainly when the silver halide is formed and a decrease of heat fog is provided by adding 2-thiouracil mainly after the reducing agent is added.

The fact will be described in detail in Example 2.

EXAMPLE 2

Heat-developable light-sensitive materials were obtained by following the same procedures as described in Example 1 except that 2-thiouracil was not added when the silver halide was formed by adding N-bromoacetamide but was added only after the reducing agent was added. The thus-obtained heat-developable light-sensitive materials were designated Samples C and C'.

Also, Samples D and D' were produced by adding 2-thiouracil only when the silver halide was formed and not adding 2-thiouracil afterwards.

The image exposure and development were carried out in the same manner as described in Example 1.

After processing, the photographic properties of each sample were measured to obtain the results as shown in Table 2 below.

Table 2

| | Sample | | | |
|---|---|---|---|---|
| | C | C' | D | D' |
| Sensitivity | 1.2 | 1.3 | 3.0 | 3.0 |
| $D_{max}$ | 1.55 | 1.95 | 1.50 | 1.90 |
| Fog (D) | 0.21 | 0.15 | 0.41 | 0.46 |

From the above results it is evident that, 2-thiouracil mainly increased the sensitivity if it were added when the silver halide was formed and mainly decreased the heat fog if were added after components such as a reducing agent, etc., are added.

The increase of sensitivity and decrease of heat fog were obtained if 2-thiouracil was added when the silver halide was formed and after various components were added as described in Example 1.

EXAMPLE 3

The same procedures as described in Example 1 were followed except that 6-ethyl-5-methyl-2-thiouracil was used instead of 2-thiouracil and that the amount of the methyl Cellosolve solution thereof at a concentration of 0.2% by weight added was 2 ml for each sample.

The thus obtained heat-developable light-sensitive material was designated Sample E.

After exposure (3000 lux·sec) as described in Example 1, the material was heated to 130° C for 15 seconds.

For comparison, the same procedures described immediately above were followed using Sample B.

The results obtained are shown in Table 3.

Table 3

| | Sample | |
|---|---|---|
| | E | B |
| Sensitivity | 4.0 | 1.0 |
| $D_{max}$ | 1.57 | 1.55 |
| Fog (D) | 0.22 | 0.53 |

It was found that Sample E which was produced by adding 6-ethyl-5-methyl-2-thiouracil in two steps provided lower heat fog and higher sensitivity in comparison with Sample B which was produced without 6-ethyl-5-methyl-2-thiouracil.

EXAMPLE 4

An aqueous solution of 0.8 g of cetylethyldimethyl ammonium bromide dissolved in 100 ml of water and 100 ml of toluene were mixed to form an emulsion. To this emulsion was added a solution of 0.425 g of silver nitrate dissolved in 10 ml of water to prepare silver bromide. The thus obtained silver bromide was present as an emulsion. Then, a solution of 12 g of lauric acid in 100 ml of toluene and a solution of 1.9 g of sodium hydroxide in 100 ml of water were mixed and emulsified, and then this emulsion was added thereto.

Then, a solution of 8.5 g of silver nitrate in 50 ml of water was added thereto to prepare silver laurate. Thus a mixture in which silver laurate contacted the silver halide was obtained.

The mixture was separated by centrifugation and added to 200 g of an ethanol solution of 30 g of polyvinyl butyral and then dispersed using a mixer to produce a polymer dispersion of the silver salt.

To this polymer dispersion of the silver salt, the following components were added successively at time intervals of 5 minutes at 30° C to prepare a coating solution.

| | | |
|---|---|---|
| (1) | Sensitizing Dye* (0.025% by weight methanol solution) | 10 ml |
| (2) | Phthalazone (phthalazinone) (toning agent) (3 wt% methanol solution) | 35 ml |
| (3) | 2,2-bis(3-Methyl-4-hydroxylphenyl)-propane (auxiliary reducing agent) (20 wt% acetone solution) and tetrakis-Methylene(3,5-ditertiarybutyl-4-hydroxyhydrocinnamate)-methane (20 wt% acetone solution) (1:9 by weight mixture). | 70 ml |
| (4) | Victoria Blue B (whitening agent) (0.05 wt% methanol solution) | 2 ml |
| (5) | 6-n-Octyl-2-thiouracil (0.2 wt% methyl Cellosolve solution) | 5 ml |

*

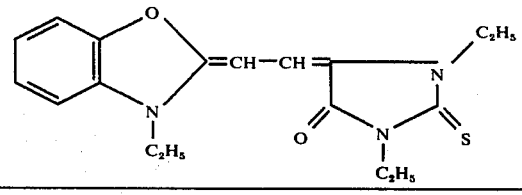

The thus obtained coating solution was coated on an art paper in a coverage of 0.5 of silver per m² of the paper.

Then an acetone solution of 10 wt% of cellulose diacetate containing 1.5 wt% of kaolin was applied to the coated light-sensitive layer to obtain a top coat polymer layer having a thickness of 1.5 $\mu$.

The thus obtained heat-developable light-sensitive material was designated Sample F.

For the purpose of comparison, a heat-developable light-sensitive material (Sample G) was produced using the above-described components except for Component (5).

The heat-developable light-sensitive materials were exposed and developed in the same manner as described in Example 1. The amount of exposure was 3000 lux·sec and the development was at 120° C for 30 seconds.

The results obtained after image formation are shown in Table 4 below.

Table 4

| | Sample | |
|---|---|---|
| | F | G |
| Sensitivity | 1.2 | 1.0 |
| $D_{max}$ | 1.60 | 1.58 |
| Fog (D) | 0.21 | 0.45 |

It has been found from the results in Table 4 that the heat fog of Sample F in comparison with Sample G was lower and Component (5) of the present invention was effective for preventing heat fog.

EXAMPLE 5

The same procedures as described in Example 4 were used except that an equal molar amount of 5-hydroxy-6-methyl-2-thiouracil dissolved in methyl Cellosolve was employed instead of 6-n-octyl-2-thiouracil of Component (5).

It has been found that the heat fog of a light-sensitive material containing 5-hydroxy-6-methyl-2-thiouracil was lower that that of Comparative Sample G of Example 4 and accordingly 5-hydroxy-6-methyl-2-thiouracil was effective for preventing heat fog.

EXAMPLE 6

3.4 g of behenic acid was dissolved in 100 ml of toluene at 60° C, and the solution was kept at 60° C. 100 ml of water was added thereto while stirring the mixture with a stirrer to form an emulsion.

Then, to an aqueous solution of 1.7 g of silver nitrate in about 80 ml of water was added aqueous ammonia to produce a silver ammine complex salt, and then additional water was added thereto to obtain an aqueous solution of a total volume of 100 ml at a temperature of 10° C. The solution was added to the above emulsion.

Thus fine crystals of silver behenate were obtained. The mixture was heated to room temperature (25° C) and allowed to stand for 20 minutes and to separate into an aqueous phase and a benzene phase. Then the aqueous phase was removed and 400 ml of water was added thereto to wash the benzene phase by decantation. Then 400 ml of methanol was added thereto and silver behenate was separated by centrifugation. 4 g of spindle-shaped silver behenate crystals having a major diameter of about 1 $\mu$ and a minor diameter of about 0.05 $\mu$ was obtained.

2.3 g of the thus obtained silver behenate (about 1/200 mol) was added to 20 ml of an ethanol solution of 2.5 g of polyvinyl butyral and dispersed for 1 hour in a ball mill to produce a polymer dispersion of the silver salt.

To this polymer dispersion of the silver salt the following components were successively added with time intervals of 5 minutes at 50° C.

| | | |
|---|---|---|
| (1) | Ammonium Bromide (silver halide forming (component) (2.5 wt% methanol solution) | 1 ml |
| (2) | 6-Methyl-2-thiouracil (0.1 wt% methyl Cellosolve solution) | 1 ml |
| (3) | Sensitizing Dye* (0.025 wt% methyl Cellosolve solution) | 1 ml |
| (4) | 2,2'-Methylenebis(6-t-butyl-4-methylphenol) (reducing agent) (25 wt% acetone solution) | 3 ml |
| (5) | Phthalazone (toning agent) (2.5 wt% methyl Cellosolve solution) | 3 ml |
| (6) | 2-Thiouracil (0.1 wt% methyl Cellosolve solution) | 3 ml |

* (a merocyanine dye having the following formula)

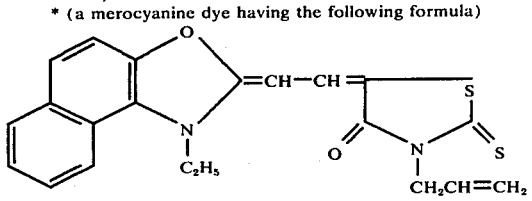

The thus prepared coating solution was coated on an art paper in a coverage of about 1 g of silver per 1 $m^2$ of the paper, and then dried to obtain a heat-developable light-sensitive material. The thus obtained heat-developable light-sensitive material was designated Sample H.

For the purposes of comparison, a heat-developable light-sensitive material (Sample I) was produced from the above-described components but Component (2) was not employed. Further, a heat-developable light-sensitive material (Sample J) was produced from the above-described components but Component (6) was not employed, a heat-developable light-sensitive material (Sample K) was produced from the above-described components but Components (2) and (6) were not employed.

The thus obtained four samples were exposed and developed in the same manner as described in Example 1.

After processing, the photographic properties of the images were measured to obtain the results shown in Table 5.

Table 5

| | Sample | | | |
|---|---|---|---|---|
| | H | I | J | K |
| Sensitivity | 3.5 | 1.3 | 3.5 | 1.0 |
| $D_{max}$ | 1.60 | 1.58 | 1.60 | 1.58 |
| Fog | 0.20 | 0.21 | 0.45 | 0.49 |

It is evident from the results shown in Table 5 that the heat fog of Sample H was low and the sensitivity of Sample H was high. Further, the heat fog of Sample I was low and the sensitivity of Sample J was high. On the other hand, the sensitivity of Sample K was low and the heat fog thereof was high. It has been concluded from these results that the effects of Components (2) and (6) are evident.

EXAMPLE 7

Similar results were obtained by following the same procedures as described in Example 6 except that the order of addition of Components (2) and (6) was reversed.

It can be said from the results of Examples 6 and 7 that, addition of Component (2) or (6) at an earlier point mainly provides an effect of increasing the sensitivity and addition of Component (2) or (6) at a later point mainly provides an effect of decreasing heat fog.

EXAMPLE 8

The same procedures as described in Example 6 were repeated except that 6-naphthyl-2-thiouracil was employed instead of Component (2) and 5-n-butyl-6-naphthyl-2-thiouracil was employed instead of Component (6) in an amount of 1 ml of a 0.2 wt% methyl Cellosolve solution, respectively, to obtain heat-developable light-sensitive materials.

The materials were processed in the same manner as described in Example 1.

Substantially the same results as those of Sample H were obtained.

EXAMPLE 9

The same procedures as described in Example 8 were followed except that the order of addition of Components (2) and (6) was reversed.

Substantially the same results as those of Sample H were obtained.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material which comprises a support containing therein or in one or more layers thereon at least (a) an organic silver salt which is substantially colorless, which is comparatively stable to light and which forms a silver image by reaction with a reducing agent when heated to a temperature above 80° C in the presence of an exposed light-sensitive silver halide, (b) a light-sensitive silver halide or a component capable of forming a light-sensitive silver halide on reaction with the organic silver salt, (c) a reducing agent, and (d) at last one of a 2-thiouracil.

2. The heat-developable light-sensitive material of claim 1, wherein said 2-thiouracil is a compound represented by the formula (I)

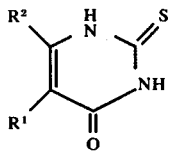

(I)

wherein $R^1$ is a hydrogen atom; a hydroxyl group; an alkoxyl group containing 1 to 5 carbon atoms; a phenoxy group; a halogen atom; an alkyl group containing 1 to 6 carbon atoms, which may be substituted with one or more of a halogen atom, a hydroxyl group, or an alkoxyl group containing 1 to 4 carbon atoms; a benzyl group; an allyl group; an amino group which may be substituted with one or two alkyl groups; a nitro group; or a nitroso group; $R^2$ is a hydrogen atom; a halogen atom; a hydroxyl group; an amino group which may be substituted with one or two alkyl groups; an acetamido group; an alkyl group containing 1 to 22 carbon atoms; or an aryl group, which may be substituted with one or more of an alkyl group containing 1 to 4 carbon atoms, a halogen atom, a hydroxyl group, an amino group which may be substituted with one or two alkyl groups, an acetamido group, or a nitro group.

3. The heat-developable light-sensitive material of claim 1, wherein said 2-thiouracil is selected from the group consisting of 2-thiouracil, 5-methyl-2-thiouracil, 5,6-dimethyl-2-thiouracil, 6-ethyl-5-methyl-2-thiouracil, 6-methyl-5-n-propyl-2-thiouracil, 5-ethyl-2-thiouracil, 5-n-propyl-2-thiouracil, 5-n-butyl-2-thiouracil, 5-n-hexyl-2-thiouracil, 5-n-butyl-6-ethyl-2-thiouracil, 5-hydroxy-2-thiouracil, 5,6-dihydroxy-2-thiouracil, 5-hydroxy-6-n-propyl-2-thiouracil, 5-methoxy-2-thiouracil, 5-n-butoxy-2-thiouracil, 5-methoxy-6-n-propyl-2-thiouracil, 5-bromo-2-thiouracil, 5-chloro-2-thiouracil, 5-fluoro-2-thiouracil, 5-amino-2-thiouracil, 5-amino-6-methyl-2-thiouracil, 5-amino-6-phenyl-2-thiouracil, 5,6-diamino-2-thiouracil, 5-allyl-2-thiouracil, 5-aryl-3-ethyl-2-thiouracil, 5-allyl-6-phenyl-2-thiouracil, 5-benzyl-2-thiouracil, 5-benzyl-6-methyl-2-thiouracil, 5-acetamido-2-thiouracil, 6-methyl-5-nitro-2-thiouracil, 6-amino-2-thiouracil, 6-amino-5-methyl-2-thiouracil, 6-amino-5-n-propyl-2-thiouracil, 6-bromo-2-thiouracil, 6-chloro-2-thiouracil, 6-fluoro-2-thiouracil, 6-bromo-5-methyl-2-thiouracil, 6-hydroxy-2-thiouracil, 6-acetamido-2-thiouracil, 6-n-octyl-2-thiouracil, 6-dodecyl-2-thiouracil, 6-tetradodecyl-2-thiouracil, 6-hexadecyl-2-thiouracil, 6-(2-hydroxyethyl)-2-thiouracil, 6-(3-isopropyloctyl)-5-methyl-2-thiouracil, 6-(m-nitrophenyl)-2-thiouracil, 6-(m-nitrophenyl)-5-n-propyl-2-thiouracil, 6-α-naphthyl-2-thiouracil, 6-α-naphthyl-5-t-butyl-2-thiouracil, 6-(p-chlorophenyl)-2-thiouracil, 6-(p-chlorophenyl)-5-ethyl-2-thiouracil, 5-ethyl-6-eicosyl-2-thiouracil, 6-acetamido-5-ethyl-2-thiouracil, 6-eicosyl-5-allyl-2-thiouracil, 5-amino-6-phenyl-2-thiouracil, 5-amino-6-(p-chlorophenyl)-2-thiouracil, 5-methoxy-6-phenyl-2-thiouracil, 5-ethyl-6-(3,3-dimethyloctyl)-2-thiouracil and 6-(2-bromoethyl)-2-thiouracil.

4. The heat-developable light-sensitive material of claim 1, prepared by incorporation of at least two 2-thiouracils, one incorporated at an early stage in the preparation of the heat-developable light-sensitive material and one incorporated at a later stage in the preparation of the heat-developable light-sensitive material.

5. The heat-developable light-sensitive material of claim 4, wherein said material includes (e) a sensitizing dye, and wherein said earlier stage in the preparation of the heat-developable light-sensitive material is a stage before incorporation of the sensitizing dye and said later stage in the preparation of the heat-developable light-sensitive material is a stage after incorporation of said reducing agent.

6. The heat-developable light-sensitive material of claim 1, wherein said silver halide is silver chloride, silver bromide, silver bromochloride, silver iodobromide, silver iodide or silver iodobromochloride.

7. The heat-developable light-sensitive material of claim 1, wherein said organic silver salt is a silver salt of an imino, mercapto, thione or carboxyl group containing organic compound.

8. The heat-developable light-sensitive material of claim 1, wherein said reducing agent is a substituted phenol, a substituted or unsubstituted bisphenol, a substituted or unsubstituted mono- or bisnaphthol, a di- or polyhydroxybenzene, a di- or polyhydroxynaphthalene, a hydroquinone monoether, ascorbic acid or a derivative thereof, a 3-pyrazolidone, a 3-pyrazolin-5-one, a reducing saccharide, an aromatic primary amino compound, a reductone, kojic acid, hinokitiol, a hydroxylamine, a hydroxytetronic acid, a hydroxytetronic acid amide, a hydroxamic acid, a sulfohydroxamic acid, a hydrazide, an indan-1,3-dione, a p-oxyphenylglycine, an ester of a carboxylic acid derived from a phenol having substituent in at least one ortho position and a mono- or polyhydric alcohol or phenol, or an ester of an alcohol derived from a polyhydric phenol having a substituent in at least one ortho position thereof or of a phenol substituted with a bulky substituent in at least one ortho position thereof and a mono- or polycarboxylic acid.

9. The heat-developable light-sensitive material of claim 1, wherein said organic silver salt is a silver salt of a long chain aliphatic acid.

10. The heat-developable light-sensitive material of claim 1, wherein said component capable of forming a light-sensitive silver halide on reacting with the organic silver salt is an inorganic halide having the formula $MX_n$ wherein M represents a hydrogen atom, an ammonium group or a metal atom, X represents a halogen atom, and $n$ is 1 when M is a hydrogen atom or an ammonium group, and $n$ is the valence of the metal when M is a metal atom; a halogen-containing metal complex; an onium halide; a halogenated hydrocarbon; an N-halo compound having the formula (II) or (III)

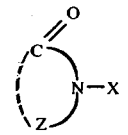

(II)

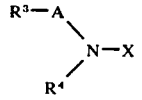

(III)

wherein X represents a halogen atom, Z represents an atomic group necessary to form a 5- to 7-membered ring, A represents a carbonyl group or a sulfonyl group, and $R^3$ and $R^4$ each represents an alkyl group, an aryl group or an alkoxy group, or an N-halobenzotriazole, an N-halobenzotriazole substituted with one or more of an alkyl group, a nitro group, a halogen atom, an imido group, or an amino group or N-bromobenzimidazole; or a halogen-containing compound selected from the group consisting of triphenylmethyl chloride, triphenylmethyl bromide, 2-bromobutyric acid, 2-bromoethanol and dichlorobenzophenone.

* * * * *